US005096085A

United States Patent [19]

Eek et al.

[11] Patent Number: 5,096,085

[45] Date of Patent: Mar. 17, 1992

[54] CRATE FOR ACCOMMODATING A PLURALITY OF BOTTLES

[75] Inventors: Johannes E. Eek, Delft; Ian L. Spoornaker, Leiderdorp, both of Netherlands

[73] Assignee: Heineken Technische Beheer B.V., Amsterdam, Netherlands

[21] Appl. No.: 719,318

[22] Filed: Jun. 21, 1991

[30] Foreign Application Priority Data

Jun. 22, 1990 [NL] Netherlands ..... 9001437

[51] Int. Cl.[5] ..... B65D 21/02

[52] U.S. Cl. ..... 220/516; 220/519; 206/427; 206/503

[58] Field of Search ..... 220/509, 512, 513, 819, 220/516, 517; 206/427, 503

[56] References Cited

U.S. PATENT DOCUMENTS

| | | | |
|---|---|---|---|
| 2,886,202 | 5/1959 | Waller | 220/509 |
| 2,935,222 | 5/1960 | O'Connell | 220/509 |
| 3,200,988 | 8/1965 | Chelbor | 220/509 |
| 3,428,207 | 2/1969 | Schoeller | 220/519 |
| 4,161,259 | 7/1979 | Palafox | 220/519 |
| 4,548,320 | 10/1985 | Box | 220/519 |
| 4,932,532 | 6/1990 | Apps et al. | 220/519 |
| 5,031,774 | 7/1991 | Morris et al. | 220/519 |

*Primary Examiner*—Joseph Man-Fu Moy
*Attorney, Agent, or Firm*—Amster, Rothstein & Ebenstein

[57] ABSTRACT

The invention relates to a crate for accommodating a plurality of bottles, comprising a bottom, four sidewalls each having a horizontal upper edge and window apertures, and partitions which form compartments for the bottles to be accommodated. The partitions terminate adjacent a sidewall in a column-shaped member which is located at least partly within the boundaries defined by the inner surfaces of the sidewalls and has a top surface extending close to the upper edge of the sidewall. According to the invention, a partition adjoining a column-shaped member, at least in the area adjacent to the column-shaped member, extends close to the upper edge of the column-shaped member. The partition has an upper edge without any vertical or substantially vertical portions and such a configuration in the area adjacent the sidewall and the column-shaped member that, viewed in the vertical direction of the crate, the line formed by the centres of gravity of the vertical force transmission is inwardly offset relative to those of the forces exerted on the upper edge of the sidewall.

12 Claims, 3 Drawing Sheets

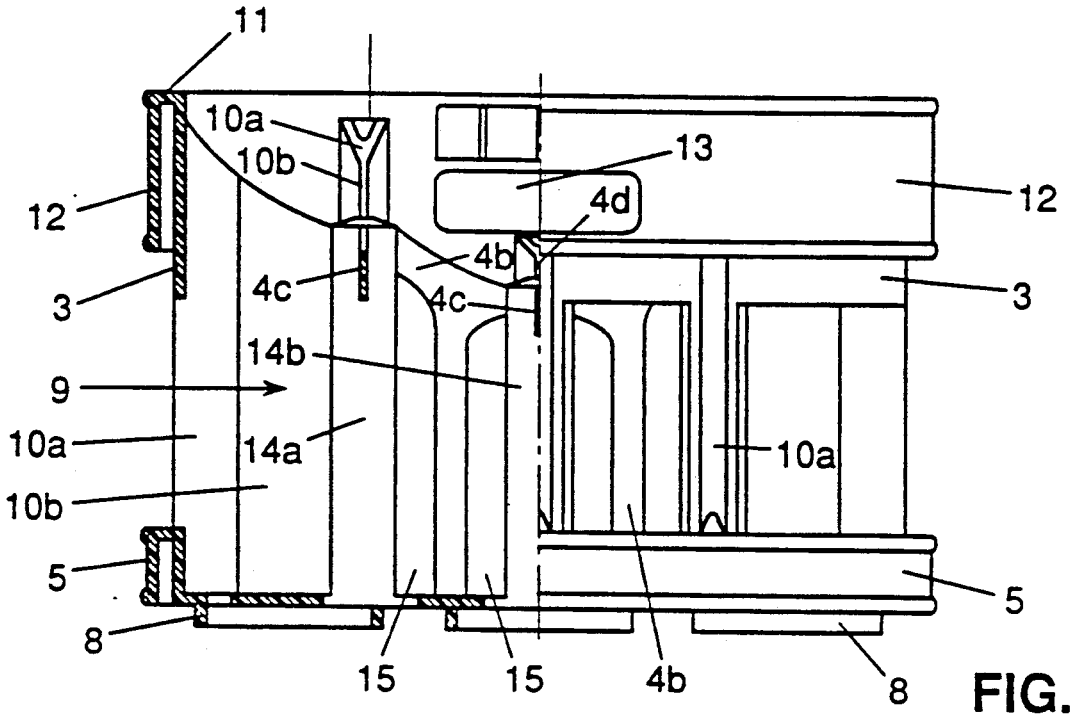
FIG. 3
FIG. 8
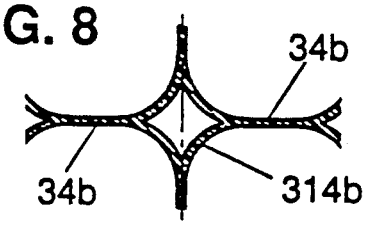
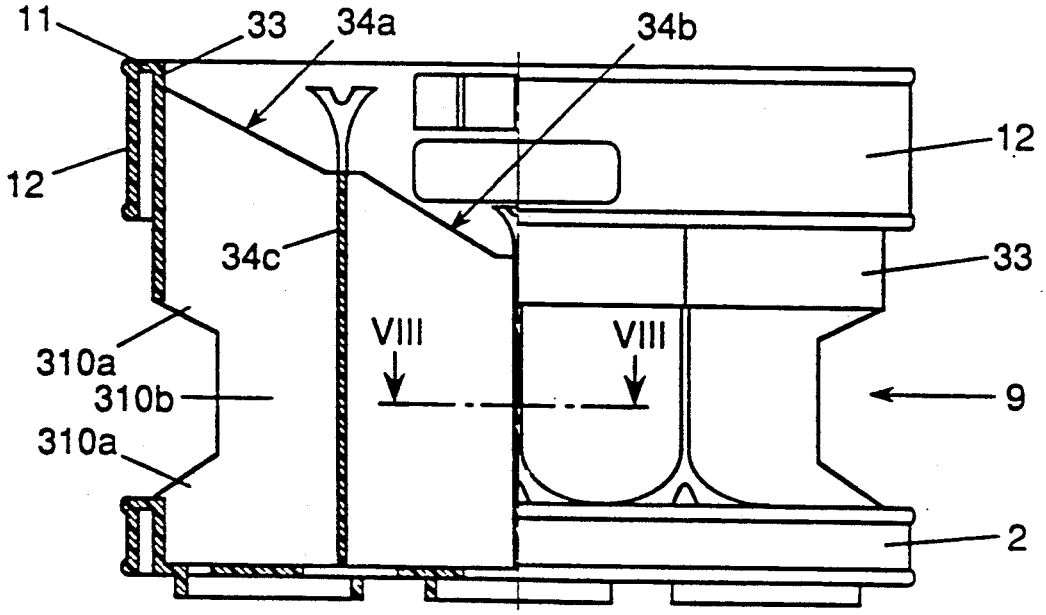
FIG. 7

CRATE FOR ACCOMMODATING A PLURALITY OF BOTTLES

This invention relates to a crate for accommodating a plurality of bottles, comprising a bottom, four sidewalls each having a horizontal upper edge and window apertures, and partitions which form compartments for the bottles to be accommodated, the partitions terminating adjacent a sidewall in a column-shaped member which is located at least partly within the boundaries defined by the inner surfaces of the sidewalls and has a top surface extending close to the upper edge of the sidewall.

Such crates with window apertures are known from, for instance, Netherlands patent application 8701081 and European patent applications 253,363 and 318,123. The window apertures have the advantage that the crates can be used for various bottled products because the labels of the bottles are at least partly visible. Thus, without making any additional provisions, such a crate can be used for accommodating bottles with varying contents, it being unnecessary for a bottle to be lifted from the crate in order that it can be read on the label what is in the bottle. The phrase "additional provisions" refers to such exchangeable means to be provided on the crate as a card to be slipped into a receiving frame, indicating the varying contents of the crate.

The display value of a crate with window apertures can be further enhanced by providing window apertures at the corner areas of the crate, as known from U.S. Pat. No. 3,432,063. Such a design, however, has a negative influence on the strength and the rigidity of the crate. Partly owing to its further construction, therefore, the known crate will not be suitable for stacking with similar crates according to interlocking patterns, for instance seven layers on a pallet and three pallets on top of each other, the bottommost crate being subject to a load of approximately 400 kg. For the crate to be usable under such conditions, it is required that the lowermost crate can be loaded in this manner without any problems at a temperature of 30° C. for at least two months.

In order to meet the strength and rigidity requirements referred to, a crate of the type described in the opening paragraph hereof may be designed as shown in German Utility Model 8702930, i.e. with relatively voluminous and robust columns despite the relatively small dimensions of the crate, which is intended for six soft drink bottles. Further, this proportionally small crate is preferably designed with relatively wide wall portions, which reduces the display value.

The object of the invention is to retain the display value of a crate with window apertures as much as possible, while maintaining a strength and rigidity which permit stacking in the manner described hereinabove, even of relatively large crates, intended for instance for 24 bottles of beer.

This is accomplished in accordance with the invention by providing a crate of the type described in the opening paragraph hereof, wherein a partition adjoining a column-shaped member, at least in the area adjacent to said column-shaped member, extends close to the upper edge of said column-shaped member, said partition having an upper edge without any vertical or substantially vertical portions and such a configuration in the area adjacent the sidewall and the column-shaped member that, viewed in the vertical direction of the crate, the line formed by the centres of gravity of the vertical force transmission is inwardly offset relative to those of the forces exerted on the upper edge of the sidewall. Through these features, the construction of partitions in the crate, which heretofore has been used mainly to provide a division into compartments, is effectively used for taking up and transmitting stacking forces. The inward displacement of the force transmission line causes a moment which subjects the upper edge area of the partition to tensile stress. That upper edge area has been arranged and designed such that it substantially prevents an outward displacement of the upper edge area of the sidewalls.

Assigning to the partitions a function in receiving and transmitting the forces brings with it that the column-shaped members are at least partly relieved and, accordingly, can be made less voluminous and robust, whereby an increase in the display value can be realized without reducing the options in stacking a plurality of such crates.

In accordance with a further embodiment of the invention, a partition terminates on the side of the sidewall in a longitudinal edge that recedes partly relative to the sidewall towards the interior of the crate and the column-shaped member is omitted at the location of the receding portion of the partition. Thus, it can even be accomplished that virtually half the circumferential surface of each bottle arranged along the sidewalls is visible by virtue of the fact that the crate is, as it were, provided with a circumferential groove extending all round. In such a design of the crate, in which the column-shaped parts are partly omitted, the force transmission in that area passing entirely by way of the partition, the material of which the crate is made will have to meet special requirements.

In practice, therefore, it will often be preferable for the column-shaped member to extend down to the bottom. The display value of the crate will be slightly reduced because of a column construction, but in many cases this will not be a disadvantage since the label remains properly visible and, moreover, the bottle portions adjacent the label must be screened in the case of light-sensitive drinks. In addition, the column-shaped members provide for a more direct force transmission, while the force transmission function of the partitions is maintained, so that less strict requirements in respect of the material need to be set, compared with the embodiment referred to in the previous paragraph.

With regard to injection moulding, it is preferable for the column-shaped member in cross-section to have the shape of an open section, such as a U or a V shape, the open end facing away from the crate. The crate will have a more aesthetic appearance and be easier to maintain if the column-shaped member in cross-section has the shape of a hollow closed section, whose outer generatrix is located in the outermost circumferential surface of the crate.

As stated, by virtue of the above-mentioned features, when pressure is applied, a partition will, in the manner of a strut connection, substantially prevent any outward bending of the upper edge area of the crate, so that it is permitted, and in accordance with a further embodiment of the invention, to have a partition terminating adjacent the upper edge of a sidewall, slope downwardly from that sidewall. Thus, that partition will hardly, if at all, affect a proper and desirable accessibility of the crate for inserting or removing a bottle. In accordance with a further embodiment of the invention, this effect can be further optimized when a partition that terminates adjacent the upper edge of a sidewall is part of a transverse wall which is formed by at least two partitions that are in line with each other and extends from said sidewall to the opposite sidewall, and the partition that adjoins the latter sidewall, at least in the area adjacent to that sidewall, extends in close proximity to the upper edge of that sidewall, whereby the upper edge of a transverse wall acquires the shape of a trough or vat in cross-section. This shape can be further influenced when, in a transverse wall formed by three or more partitions, a partition that adjoins a partition in turn adjoining a sidewall slopes downwardly from said point of abutment. By virtue of these features, opposite sidewalls are, as it were, connected in arch bridge fashion, which has a further positive influence on the strength and rigidity of the crate.

In fact, only the partitions at or near specific pressure points in an interlocking stacking pattern need to extend close to the upper edge of the crate. However, because the pressure points may differ depending on the location within a stack, it is preferable, partly in view of symmetry and manufacture, and in accordance with a further embodiment of the invention, for all partitions that adjoin one and the same sidewall, to extend close to the upper edge of that sidewall, at least in the area adjacent to that sidewall.

As explained above, the partitions can be effectively used when their upper and lower ends are subjected to pull. In order to improve this load profile, it may be preferable, and in accordance with a further embodiment of the invention, that a horizontal outwardly extending collar adjoins the upper edge of the sidewall, this collar in turn being adjoined by a vertical downwardly extending flange. By virtue of this feature, the pressure loads to be received and transmitted are substantially displaced slightly outwardly relative to the sidewall of the crate, so that the strengthening action of the partitions can have optimum effect.

By virtue of the fact that in accordance with the invention the forces acting on said specific points can be taken up in fairly optimum manner, the display value of the crate can be maximized not only at the corners but also at the longitudinal sidewalls, in particular because it is possible for the sidewalls to be omitted entirely at the location of the window apertures and for the sidewalls to be connected with the bottom by means of the partitions.

When, in accordance with a further embodiment of the invention, a pillar-shaped element is arranged at the intersections of a first set of parallel transverse walls and a second set of parallel transverse walls extending perpendicular to the first set, it is further possible to better adjust a compartment formed by the partitions in the crate to the typically circular section of a bottle, which adjustment can be further improved by an appropriate choice of a column-shaped member.

According as a partition is spaced further from a sidewall, it contributes less to the strengthening effect of the crate as discussed. In view thereof, according to a further embodiment of the invention, it is proposed to provide the partitions that do not adjoin the sidewalls with recesses, which recesses can be selected such that the partitions are substantially Y-shaped. Thus, crate material can be saved and the weight of the crate is reduced without the strength and rigidity thereof being materially influenced.

The crate according to the invention will now be further discussed and illustrated, by way of example only, with reference to the embodiments shown in the accompanying drawings, in which:

FIG. 3 is a partly front elevational and partly sectional view taken on the line III—III of FIG. 4 of the short side of the crate according to FIG. 1;

FIG. 7 is a cross-section of the crate according to FIG. 6; and

FIG. 8 is a cross-section taken on line VIII—VIII of FIG. 7.

Figure 1:
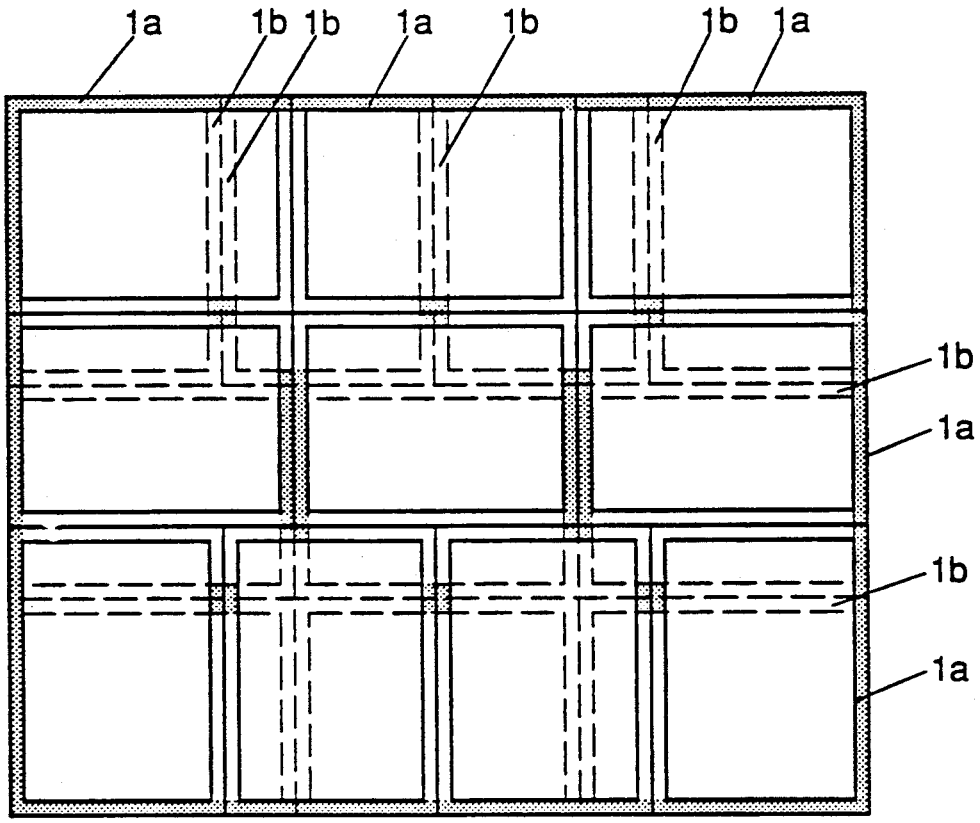
FIG. 1 shows a conventional crate stacking pattern.

FIG. 1 shows two layers of a conventional stacking pattern of a plurality of crates 1*a* and 1*b*, the top layer of crates 1*a* being shown in solid lines and the bottom layer of crates l*b* being shown in broken lines. As will appear from the drawing, the top layer has been rotated about a vertical axis through 180° relative to the bottom layer. Such portions of the lower edges of the top layer of crates 1*a* as make contact with the upper edges of the lower crates l*b* have been indicated by a pattern of dots. The elongate contact areas will present few problems in receiving and transmitting stacking forces. The more point-like contact areas could be more critical in respect of the vertical force transmission therethrough. As will appear from FIG. 1, the latter contact areas are always spaced from the corners. The crate construction according to the invention is partly based on this insight, i.e. this insight offered the possibility of dispensing with corner supports, provided that a proper force reception and transmission is ensured in a different manner, preferably approximately at said more or less point-shaped contact areas. According to a further aspect of the invention, this force reception and transmission was found in a special construction of the partitions, which form a compartment division in the crate, as will be explained hereinafter with reference to the embodiment shown in FIGS. 2–4, 5 and 6–8.

Figure 2:
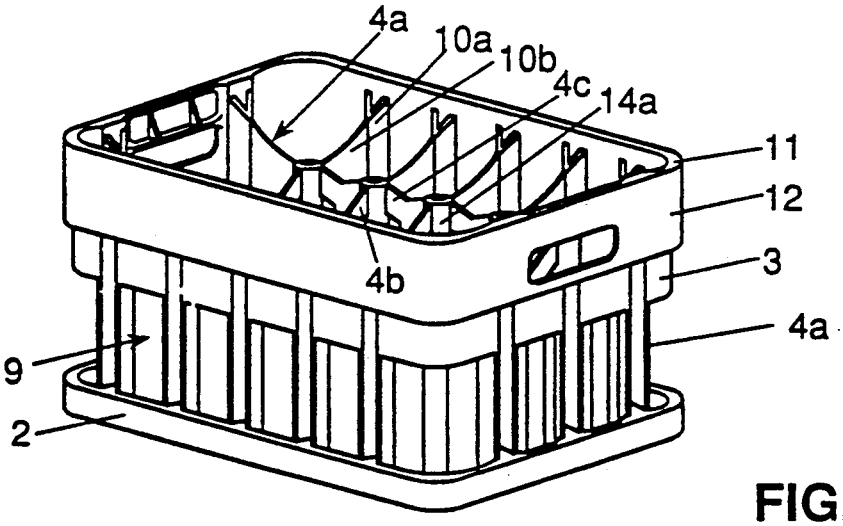
FIG. 2 is a perspective view of a first embodiment of a crate according to the invention.

FIG. 2 is a perspective view of a first embodiment of the crate 1 according to the invention, which crate comprises a substantially rectangular bottom 2, four sidewalls 3 and partitions 4*a–d*, which form a compartment division for the bottles to be accommodated (not shown).

The bottom 2 consists of an edge 5 U-shaped in cross-section (see FIG. 3), a plate-shaped bottom member comprised of rings 6 and strips 7 (see FIG. 4) and short shell-shaped foot members 8 (see FIG. 3). The foot members 8 are arranged in such a way that it remains possible to stack the crates in the manner described with reference to FIG. 1 and the foot members extend into the open upper part of at least one subjacent crate, thereby preventing a lateral displacement and enabling an interlock to be accomplished between two subjacent crates.

Provided in the sidewalls 3 are window apertures 9, which are separated from each other by a column-shaped member 10*a* of V-shaped cross-section forming a part of a partition 4*a*, the tip of the V-shape adjoining the remaining, plate-shaped member 10*b* of that partition 4a. Thus, the sidewall is omitted throughout the height of the window apertures 9. At its upper edge, each sidewall 3 is provided with a horizontal outwardly extending collar 11 which in turn has a vertical downwardly extending flange 12 connected to it. At the two short sides of the substantially rectangular crate 1, the sidewalls 3 and the flanges 12 are provided with gaps 13 permitting the crate 1 to be picked up and moved.

The partitions 4a–d arranged within the surrounding sidewalls 3 form a compartment division for the bottles to be accommodated (not shown). This compartment division is shown most clearly in FIG. 4. At each point where four partitions meet, a pillar 14a–b is arranged.

The partitions 4a, at one end connecting to a sidewall 3 through their V-shaped column-shaped member 10a and, at the other end, connecting to a pillar 14a through their plate-shaped member 10b, are designed in accordance with the invention, such that they terminate near the upper edge of the sidewall, i.e. the collar 11. From the abutment point on the sidewall 3, the upper edge of a partition 4a slopes downwardly and at its other end adjoins the upper end of a pillar 14a, which, accordingly, has a length which is shorter than the internal height of the crate 1. Thus, a receiving compartment partly formed by such a partition 4a remains properly accessible for inserting therein and removing therefrom a bottle. The further effect of the column-shaped members 10a and the pillars 14a is that the cross-section of such a receiving compartment is better adjusted to the typically circular cross-section of a bottle. In view of the display character of the crate 1, it may be preferable to arrange means in a receiving compartment, which maintain the rotational position of a bottle upon insertion, so that a bottle, once it has been inserted in the crate with its label directed towards the window aperture, will remain so positioned, for instance during transport, in such a way that the label will invariably be optimally visible.

When a second, similar crate or a stack of such crates are arranged on the crate 1 shown in FIG. 2, the weight thereof will press onto the upper edge of the sidewall 3. Owing to the shifting of the foot members 8 of a superjacent crate along the inside of the sidewall 3 of a subjacent crate, the sidewall will want to move outwardly when the force exerted is such that the sidewall wants to move laterally. Such displacement, however, is effectively prevented by the partitions 4a terminating adjacent the upper edge of the sidewall 3, which partitions will thereby be subjected to a pull in the area of their upper edge, namely in the direction in which the partition can optimally receive and transmit a load. It is noted that, as explained with reference to FIG. 1, specific pressure points in a stack are spaced from the corner points, i.e. at or near the partition 4a, which promotes optimum take-up of a stacking load.

It is further observed that the collar 11 is arranged so as to extend outwardly from the sidewall 3. As a result, a stacking force that is being exerted will have a stronger tendency to want to push the sidewall outwardly and thereby promote the desired load profile of the partitions 4a.

The partitions 4b extend from a pillar 14a to a lower pillar 14b, which is spaced further from the sidewalls 3 than is the pillar 14a. The stacking forces coming from the collar 11, to be received and transmitted by the partition 4b, are considerably smaller than the corresponding forces for the partition 4a. Accordingly, to save weight and material, the partitions 4b are provided with recesses, such that the partitions acquire a shape which can roughly be designated by the latter "Y". This shape can be seen more clearly in partitions 4c (see FIG. 2 in particular), which extend between two pillars 14a or two pillars 14b of equal height.

Figure 4:
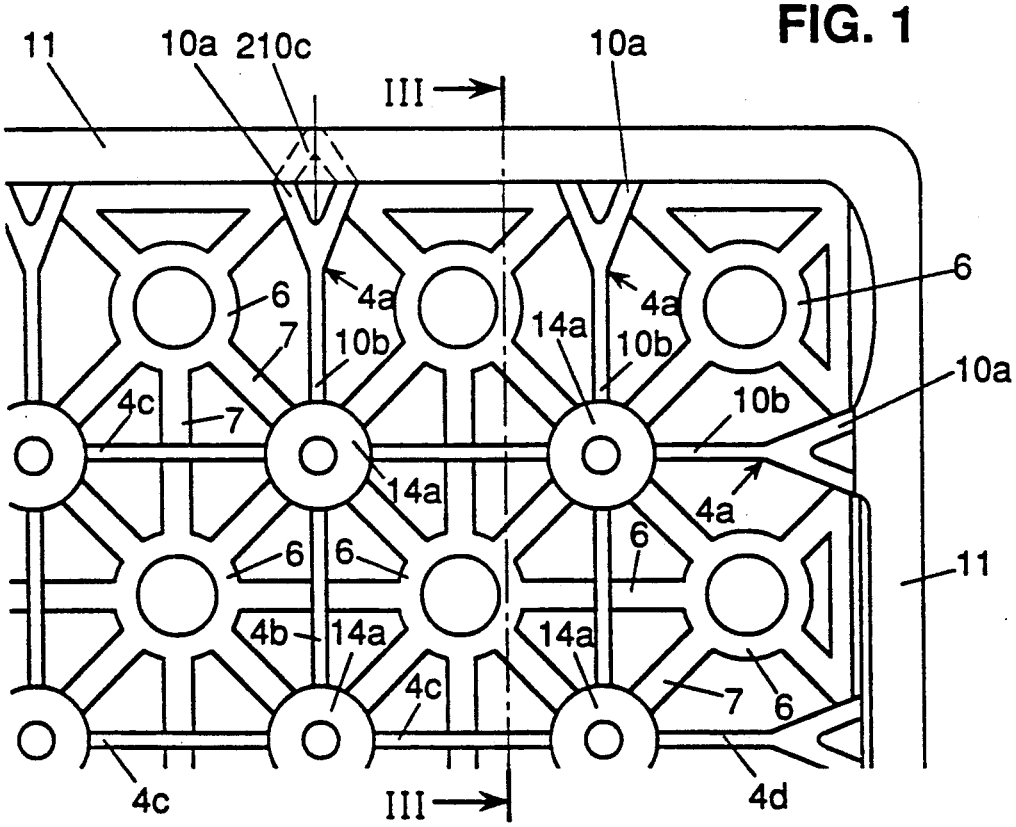
FIG. 4 is a top plan view of a part of the crate according to FIG. 1.

As will be clear from FIGS. 2–4, a plurality of partitions 4a and 4b in line with each other form a transverse wall extending parallel to the short side of the crate, the upper edge thereof having a substantially arcuate shape, which is comparable with a cross-sectional line of a trough or vessel. Thus, a further reinforcement of the crate construction between the long sides thereof is obtained in the manner known in arch bridges. A plurality of successive partitions 4a and 4c provide for a similar connection between the short sides of the crate.

As will appear from FIG. 3, at the location of a cutout 13 in a short side of the crate 1, the corresponding partition 4d adjoining the sidewall 3 does not extend close up to the upper edge of the sidewall, so as to permit a hand to pass freely through the gap. Such a lower partition can be provided without materially affecting the strength of the crate, on the one hand because the upper edge area above the gap is provided with strengthening and stiffening ribs, and on the other hand because there are no specific pressure points in the central area of the short side of the crate. As will be clear from FIG. 1, in a stack of interlocking crates, such pressure points will lie at approximately one quarter of the length of the short side of the crate: see the two central crates in a row of four. FIG. 1 further shows that the pressure points on the long sides lie half way the length of the long side of the crate or at approximately one fifth of that length from a corner point of the crate. Accordingly, optionally the second and the fourth partition 4a connecting to a long side as shown in FIG. 2 could be of lower design, for instance in the manner of partiton 4d in FIG. 3.

Figure 5:
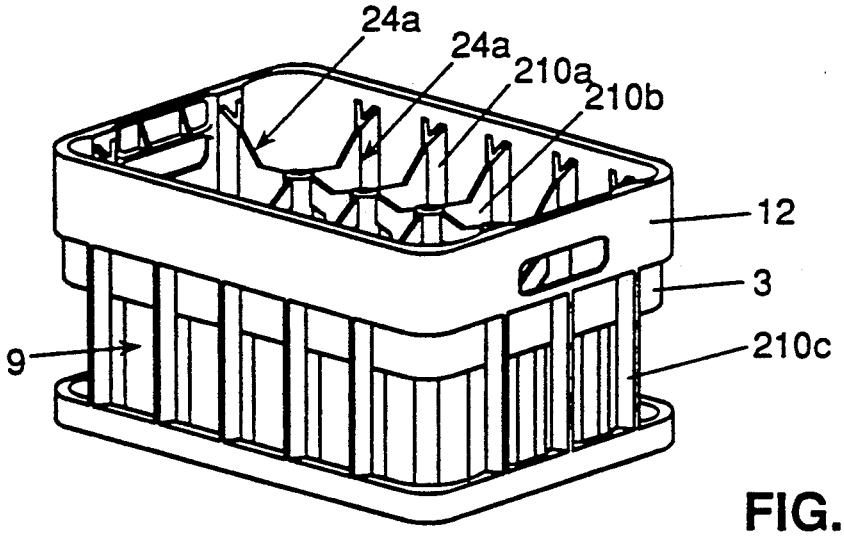
FIG. 5 is a perspective view of a second embodiment of a crate according to the invention.

FIG. 5 shows a variant of the crate as shown in FIG. 1, like parts being indicated by like reference characters. The two embodiments differ in the design of the partitions 24a connecting to the sidewalls 3. The first difference is that the upper edge of the partitions 24a has a more obtuse rather than flowing, curved configuration, so as to further facilitate access to the compartments arranged along the sidewalls 3. The second difference is that the open V-shape of a column-shaped member 210a is closed by means of a second column-shaped member 210c, which likewise has a V-shape in cross-section, the open end thereof connecting to the open end of the column-shaped member 210a and its tip terminating in the outer plane of the flange 12. To illustrate this, in FIG. 4, one of such column-shaped members 210c is indicated by a broken line. The additional column-shaped member 210c may be provided for aesthetic reasons or for maintenance reasons, since on the one hand a more uniform appearance is obtained and on the other hand inwardly receding grooves in which dirt may collect are thus avoided. Such an additional column-shaped member 210c will also yield a further strength improvement without adversely affecting the display value of the crate. It is further observed that, as in the embodiment according to FIG. 2, the absence of corner supports is a characteristic identifying mark of the crate. This aspect can be retained when opting for yet other designs of the column-shaped members, which, it will be clear, may have many other cross-sectional shapes, in addition to those shown in the embodiments. Naturally the same applies to partitions and pillars used in the crate, which, as stated above, may for instance be further provided with means for retaining an inserted bottle in position. It is important that at the points further specified hereinabove, a partition extends close up to the upper edge of the adjoining sidewall of the crate and the force transmission takes place within the sidewall, so that the partitions effectively cooperate in taking up the force.

Figure 6:
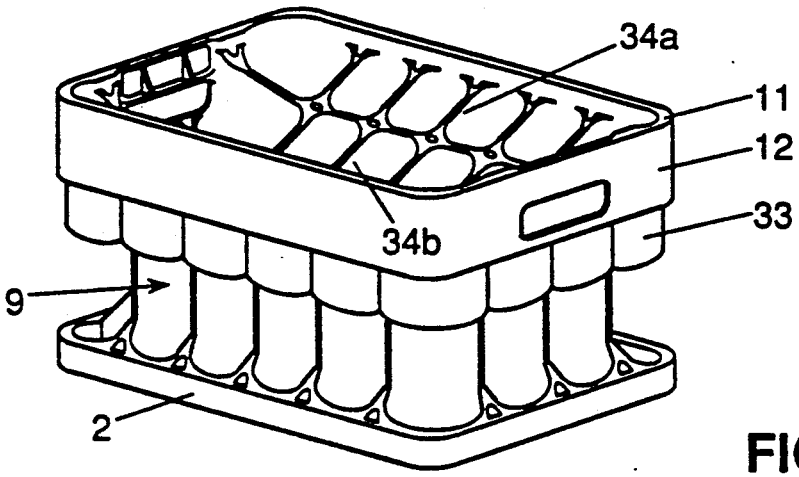
FIG. 6 is a perspective view of a third embodiment of a crate according to the invention.

FIGS. 6–8 show a third embodiment of the crate according to the invention. Again, like elements are indicated by like reference characters. Thus, the crate comprises a substantially rectangular bottom 2, consisting of an edge 5 U-shaped in cross-section (see FIG. 7), a plate-shaped bottom member and short shell-shaped foot members 8. Again, a horizontal collar 11 with a vertical flange 12 connects to the upper edges of the four sidewalls 33. Again, partitions 34*a–c* provide for a division into compartments for the bottles, a pillar 314*a–b* being arranged at an intersection of four partitions. Again, the partitions 34*a* are comprised of a plate-shaped member 310*b* and a V-shaped member 310*a*, the legs of the V-shape being curved in such a way that a leg together with an adjacent leg forms an arc of a circle adapted to the cross-section of the bottles to be accommodated (not shown).

As will appear most clearly from FIG. 7, the basically column-shaped V-shaped member 310*a* is provided with a gap at the location of the window apertures 9, so that a particularly characteristic appearance is obtained (see FIG. 6) and the display value of the crate, compared with the embodiments discussed hereinabove, is further increased. It will be clear that such a design of the crate is possible only by directing the force transmission through the partitions, in accordance with the invention.

It will be clear that, within the framework of the invention, many modifications and variants are conceivable. A number of those variants have already been discussed in the foregoing. As stated, the sidewall is absent at the location of the window apertures 9. From the foregoing, it will also be clear that the height over which that sidewall is omitted is less relevant to the strength of the crate. Accordingly, the height of the sidewall as shown could be reduced even further. However, the selection of the height of the sidewall is determined by other factors than strength. In a number of cases, the height should preferably be selected such that only a label is visible, for instance on account of the light sensitivity of the beverage. The height selected may also be determined by the shape of the bottles which are to be accommodated in the crate. If the sidewall is too low, the bottles might fall from the crate by way of the window apertures.

We claim:

1. A crate for accommodating a plurality of bottles, comprising a bottom, four sidewalls each having a horizontal upper edge and window apertures, and partitions which form compartments for the bottles to be accommodated, said partitions terminating adjacent a sidewall in a column-shaped member which is located at least partly within the boundaries defined by the inner surfaces of the sidewalls and has a top surface extending close to the upper edge of said sidewall, characterized in that a partition adjoining a column-shaped member, at least in the area adjacent to said column-shaped member, extends close to the upper edge of said column-shaped member, said partition having an upper edge without any vertical or substantially vertical portions and such a configuration in the area adjacent the sidewall and the column-shaped member that, viewed in the vertical direction of the crate, the line formed by the centres of gravity of the vertical force transmission is inwardly offset relative to those of the forces exerted on the upper edge of the sidewall.

2. A crate according to claim 1, characterized in that the column-shaped member in cross-section has the shape of an open section, such as a U or V shape, the open end facing away from the crate.

3. A crate according to claim 1, characterized in that said partition terminates on the side of the sidewall in a longitudinal edge which partly recedes relative to the sidewall towards the interior of the crate, the column-shaped member being omitted at the location of the receding portion of the partition.

4. A crate according to claim 1 characterized in that a partition terminating adjacent the upper edge of a sidewall slopes downwardly from said sidewall.

5. A crate according to claim 1, characterized in that a partition terminating adjacent the upper edge of a sidewall is part of a transverse wall which is formed by at least two partitions that are in line and extends from said sidewall to the opposite sidewall, and the partition adjoining said opposite sidewall, at least in the area adjacent said sidewall, extends close to the upper edge of said sidewall.

6. A crate according to claim 1, characterized in that all partitions adjoining one and the same sidewall extend close to the upper edge of said sidewall, at least in the area adjacent to said sidewall.

7. A crate according to claim 1, characterized in that a horizontal outwardly extending collar adjoins the upper edge of a sidewall, said collar in turn being adjoined by a vertical downwardly extending flange.

8. A crate according to claim 1, characterized in that the sidewalls are omitted completely at the location of the window apertures and the sidewalls are connected to the bottom by means of the partitions.

9. A crate according to claim 5, characterized in that in a transverse wall formed by three or more partitions, a partition adjoining a partition which in turn adjoins a sidewall, slopes downwardly from the connection point.

10. A crate according to claim 5, characterized in that a pillar-shaped member is arranged at the intersections of a first set of parallel transverse walls and a second set of parallel transverse walls extending at right angles to said first set of transverse walls.

11. A crate according to claim 5, characterized in that the partitions that do not adjoin the sidewalls are provided with recesses.

12. A crate according to claim 11, characterized in that the recesses are chosen such that the partitions are substantially Y-shaped.

* * * * *